United States Patent [19]

Hawkins

[11] Patent Number: 4,844,273

[45] Date of Patent: Jul. 4, 1989

[54] CLOSURE WITH ENHANCED SEALING

[75] Inventor: H. Gene Hawkins, Evansville, Ind.

[73] Assignee: Sunbeam Plastics Corporation, Evansville, Ind.

[21] Appl. No.: 240,630

[22] Filed: Sep. 6, 1988

[51] Int. Cl.[4] ..... B65D 53/02

[52] U.S. Cl. ..... 215/329; 215/343; 215/352; 215/341

[58] Field of Search ..... 215/329, 352, 343, 341

[56] References Cited

U.S. PATENT DOCUMENTS

| | | | |
|---|---|---|---|
| 3,074,579 | 1/1963 | Miller . | |
| 3,677,430 | 7/1972 | Yates, Jr. | 215/352 X |
| 3,844,439 | 10/1974 | Demers et al. | 215/344 |
| 4,090,631 | 5/1978 | Grussen | 215/341 X |
| 4,177,905 | 12/1979 | Winchell et al. | 215/341 X |
| 4,346,812 | 8/1982 | Banich, Sr. | 215/352 |
| 4,383,620 | 5/1983 | Mumford | 215/341 X |
| 4,540,102 | 9/1985 | Wiedmer | 215/344 |
| 4,570,811 | 2/1986 | Lecinski et al. | 215/343 |
| 4,709,825 | 12/1987 | Mumford | 215/343 X |

FOREIGN PATENT DOCUMENTS

| | | |
|---|---|---|
| 557090 | 2/1957 | Italy . |
| 1583024 | 1/1981 | United Kingdom . |

*Primary Examiner*—Donald F. Norton

*Attorney, Agent, or Firm*—Gifford, Groh, Sheridan, Sprinkle and Dolgorukov

[57] ABSTRACT

A closure having an enhanced seal for withstanding distortion of the closure and the container to which it is attached during sterilization.

An inner plug cooperates with an outer bead to capture the container neck lip and maintain a separate resilient hermetic seal in position between the closure top and the container neck lip.

5 Claims, 1 Drawing Sheet

CLOSURE WITH ENHANCED SEALING

This invention relates to closures for attachment to container necks, and, more particularly to an enhanced closure seal capable of maintaining a sealing relationship with the container neck when subjected to sterilization temperatures.

The problems involved in maintaining a seal between a plastic container and closure at sterilization temperatures of up to 270° F. are severe. Above 250° F. the closure and container have the structural integrity of jelly with the container collapsing upon itself and the product contained therein, and the closure cap rests on the container neck with its original seal barely intact or broken by the collapsing of the container and the relaxing of the closure.

Attempts to solve the problem of maintaining the seal at these elevated temperatures have been varied, but most solutions involve the use of two or more seals in series with the expectation that at least one seal will be maintained. Typical among approaches advanced is the use of multiple sealing fins or rings which depend from the cap top to engage the container lip in the manner shown in U.S. Pat. No. 3,844,439. This type of seal can be successful in coping with the problem of irregularities in the formation of a container neck, but when the seal is subjected to higher sterlization temperatures, the tendency is for all seal rings to leak.

Other attempts to solve the problem have been directed to the use of a separate elastic sealing member capable of withstanding high temperatures. Unfortunately, the failures do not occur in the elastic sealing member, but in the structure in which it is put.

The present invention is directed to the solution of this high temperature sealing problem.

This invention provides a plastic closure particularly adapted for maintaining a sealing relationship with the lip of a container neck when subjected to sterilization temperatures. A cap having a top and inner and outer coaxial skirts depending from the top is provided. The outer skirt has means for attachment to the container neck usually in the form of threads or a snap over flange. The inner skirt provides a plug seal which has an interference fit with the container neck lip. A small bead projects inwardly from the outer skirt above the threads or other attachment means for peripheral contact with the container neck lip. An elastic sealing member, typically in the form of an O-ring is located between the inner and outer skirts and is adapted to be compressed between the cap top and the container neck lip. Thus, a reliable closure seal is established by capturing and maintaining a rigid structure on both sides of the container neck lip which, in turn, cooperates and maintains the elastic sealing member in compression to maintain a hermetic seal between the container neck lip and the cap top during the distortion that takes place in a sterilization process. Hence, the multiple contact surfaces cooperate with one another to perform the sealing function as opposed to the prior art use of a series of seals with the expectation of at least one of the seals remaining intact.

The preferred embodiments of the invention are illustrated in the drawing in which.

Figure 1:
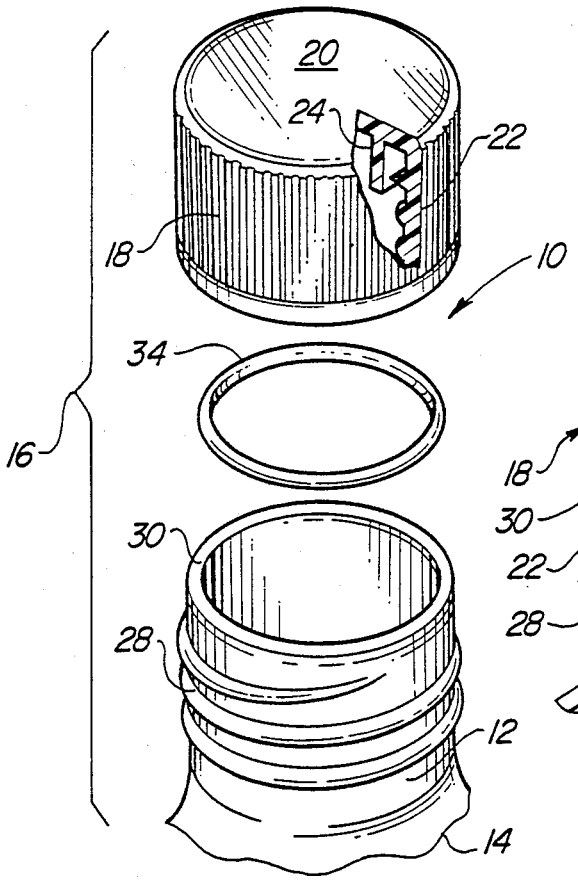
FIG. 1 is an exploded perspective view of the closure including an O-ring as an elastic sealing member as the closure and O-ring is being applied to the container neck lip.

The enhanced sealing closure 10 of this invention is shown as it is applied to the neck 12 of container 14 to comprise a closure - container package 16. Closure 10 includes a cap 18 having a top 20 with depending coaxial outer skirt 22 and inner skirt 24. Outer skirt 18 has internal threads 26 for engaging complementary external threads 28 on the container neck attaching the closure to the container.

Figure 2:
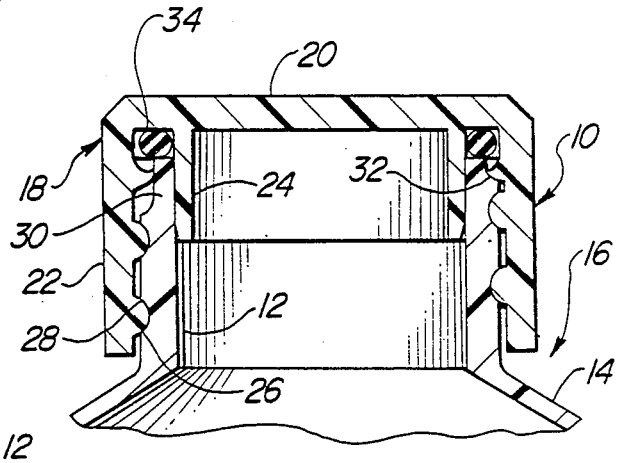
FIG. 2 is a sectional elevational view showing the closure in place on the container neck with the three elements of the seal of this invention coacting between the closure and the container neck lip.

The enhanced seal of this invention includes three elements which cooperate together to seal the cap to the container neck lip 30. Inner skirt 24 serves as one of these elements by having an interference fit with the inside of the container neck lip 30. Bead 32 projecting inwardly from outer skirt 22 provides the second sealing element of the enhanced closure seal which maintains peripheral contact against the outside of the container neck lip 30. The third sealing element is an elastic sealing member shown in FIGS. 1 and 2 as an O-ring 34, located between the outer and inner skirts 22 and 24 to be compressed between the cap top 20 and the container lip 30 to establish and maintain a hermetic seal when cap 18 has been threaded onto container neck 12. The seal thus constitutes the rigid inner skirt 24 which firmly presses against the inside of lip 30 which coacts with the inwardly directed bead 32 maintaining peripheral contact with the outside of lip 30 to retain the O-ring 34 in compression between the cap top 20 and container lip 30.

Figure 3:
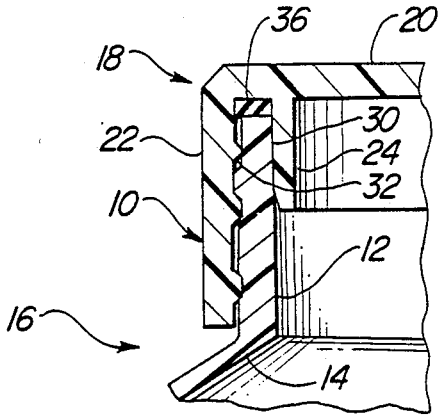
FIG. 3 is a partial cross sectional view similar to FIG. 2 but showing the use of a flowed in material for the elastic sealing member in place of the O-ring in FIG. 2.

FIG. 3 shows an alternate form of the invention employing an elastic sealing member 36 in the form of a flowed in material such as a plastisol.

The described closure 10 of this invention thus provides a three element seal which maintains its integrity under sterilizing temperatures by capturing the container lip 30 between the rigid inner skirt and the outer sealing bead to hold the elastic sealing element 34, 36 in compression between the cap top 20 and the container lip 30.

In a preferred embodiment of the invention, the bead 32 is continuous so that in addition to the hermetic seal established by the elastic element 32, a second seal is obtained with the outside surface of lip 30 and a third seal is established with the inside surface of lip 30 by the interference fit of the rigid inner skirt 24.

The embodiments of the invention in which an exclusive property or privilege is claimed are defined as follows:

1. A plastic closure particularly adapted for maintaining a sealing relationship with the lip of a container neck when subjected to sterilization temperatures, comprising:

a cap having a top and inner and outer coaxial skirts depending therefrom, said outer skirt having means for attachment to said container neck and said inner skirt providing a plug seal having an interference fit with said container neck lip;

a bead projecting inwardly from said outer skirt above said attachment means for peripheral sealing contact with said container neck lip; and an elastic sealing member separate from and of a material different than said cap located between said inner and outer skirts adapted to be compressed between said cap top and said container neck lip thereby maintaining a seal by capturing and maintaining a rigid structure on both sides of the container neck lip and maintaining an elastic sealing member in compression to maintain a hermetic seal between the container neck lip and the cap top during the distortion that takes place in the sterilization process.

2. The closure according to claim 1 wherein said means for attachment includes internal threads on said outer skirt which cooperate with external threads on said container neck.

3. The closure according to claim 1 wherein said bead is continuous to maintain a seal with the outside of the container neck lip, and the interference fit of the inner skirt maintains a seal with the inside of the container lip.

4. A plastic closure particularly adapted for maintaining a sealing relationship with the lip of a container neck when subjected to sterilization temperatures, comprising:

a cap having a top and inner and outer coaxial skirts depending therefrom, said outer skirt having means for attachment to said container neck and said inner skirt providing a plug seal having an interference fit with said container neck lip;

a bead projecting inwardly from said outer skirt above said attachment means for peripheral sealing contact with said container neck lip; and an elastic sealing member in the form of an O-ring located between said inner and outer skirts adapted to be compressed between said cap top and said container neck lip thereby maintaining a seal by capturing and maintaining a rigid structure on both sides of the container neck lip and maintaining an elastic sealing member in compression to maintain a hermetic seal between the container neck lip and the cap top during the distortion that takes place in the sterilization process.

5. A plastic closure particularly adapted for maintaining a sealing relationship with the lip of a container neck when subjected to sterilization temperatures, comprising:

a cap having a top and inner and outer coaxial skirts depending therefrom, said outer skirt having means for attachment to said container neck and said inner skirt providing a plug seal having an interference fit with said container neck lip;

a bead projecting inwardly from outer skirt above said attachment means for peripheral sealing contact with said container neck lip; and an elastic sealing member in form of flowed in gasket material located between said inner and outer skirts adapted to be compressed between said cap top and said container neck lip thereby maintaining a seal by capturing and maintaining a rigid structure on both sides of the container neck lip and maintaining an elastic sealing member in compression to maintain a hermetic seal between the container neck lip and the cap top during the distortion that takes place in the sterilization process.

* * * * *